US006124675A

United States Patent [19]

Bertrand et al.

[11] Patent Number: 6,124,675

[45] Date of Patent: Sep. 26, 2000

[54] METASTABLE ATOM BOMBARDMENT SOURCE

[75] Inventors: Michel J. Bertrand, Verdun; Denis Faubert; Olivier Peraldi, both of Montreal; André L'Heureux, Lévis, all of Canada

[73] Assignee: University of Montreal, Quebec, Canada

[21] Appl. No.: 09/088,079

[22] Filed: Jun. 1, 1998

[51] Int. Cl.[7] ..... H01J 7/24

[52] U.S. Cl. ..... 315/111.91; 315/111.81; 315/111.21; 250/426; 250/427; 313/359.1

[58] Field of Search ..... 315/111.81, 111.21, 315/111.41, 111.71, 111.91; 250/426, 427, 425; 313/361.1, 362.1, 363.1, 359.1

[56] References Cited

U.S. PATENT DOCUMENTS

| | | | |
|---|---|---|---|
| 3,392,280 | 7/1968 | Friedman et al. . | |
| 3,619,605 | 11/1971 | Cook et al. . | |
| 3,902,064 | 8/1975 | Young . | |
| 4,060,708 | 11/1977 | Walters . | |
| 4,148,612 | 4/1979 | Taylor et al. | 436/35 |
| 4,398,152 | 8/1983 | Leveson . | |
| 4,408,125 | 10/1983 | Meuzelaar . | |
| 4,481,062 | 11/1984 | Kaufman et al. . | |
| 4,546,253 | 10/1985 | Tsuchiya et al. . | |
| 4,818,862 | 4/1989 | Conzemius . | |
| 4,948,962 | 8/1990 | Mitsui et al. . | |
| 5,083,061 | 1/1992 | Koshiishi et al. | 315/111.81 |
| 5,086,226 | 2/1992 | Marcus . | |
| 5,367,164 | 11/1994 | Schultz . | |
| 5,485,016 | 1/1996 | Irie et al. . | |
| 5,594,243 | 1/1997 | Weinberger et al. . | |
| 5,942,854 | 8/1999 | Ryoji et al. | 315/111.21 |

OTHER PUBLICATIONS

Pascal Mireault, Denis Faubert, Gary J.C. Paul et al., "LC/MAB/MS: A new Ionization Techniques for LC/MS", 41st Int'l Conference on Analytical Sciences and Spectroscopy, Ontario, Canada, Aug. 14–16, 1995.

Denis Faubert, Pascal Mireault & Michel J. Bertrand, "MAB: A Novel Ionization Source Providing Selective Ionization and Fragmentation", 41st Int'l Conference on Analytical Sciences and Spectroscopy, Ontario, Canada, Aug. 14–16, 1995.

Denis Faubert, Pascal Mireault & Michel J. Bertrand, "Analytical Applications of the MAB Source for the Analysis of Organic Compounds", 3rd Int'l Symposium on Applied Mass Spectrometry in the Health Sciences/European Tandem Mass Spectrometry Conference, Barcelona, Spain, Jul. 9–13, 1995.

Denis Faubert, Alain Carrier, Pascal Mireault & Michel J. Bertrand, "LC/MAB/MS: A New Ionization Technique for LC/MS", 3rd Int'l Symposium on Applied Mass Spectrometry in the Health Sciences/European Tandem Mass Spectrometry Conference, Barcelona, Spain, Jul. 9–13, 1995.

Denis Faubert, Moussa Mousselmal, Marc Cyr & Michel J. Bertrand, "Pyrolysis Analysis in Direct Combination with the Metastable Atom Bombardment (MAB) Source", 14th Int'l Mass Spectrometry Conference, Tampere, Finland, Aug. 25–29, 1997.

Denis Faubert, Moussa Mousselmal, Andreea Vuica et al., "Characteristics of the MAB Source as a Common Ion Source for Mass Spectrometry", 14th Int'l Mass Spectrometry Conference, Tampere, Finland, Aug. 25–29, 1997.

D. Faubert, G.J.C. Paul, J. Giroux & M.J. Bertrand, "Selective fragmentation and ionization of organic compounds using an energy–tunable rare–gas metastable beam source", 14th Int'l Mass Spectrometry Conference, Tampere, Finland, Aug. 25–29, 1997.

D. Faubert, P. Mireault & M.J. Bertrand, "Analytical Potential of the MAB source for routine analysis of organic compounds", 43rd ASMS Conference on Mass Spectrometry and Allied Topics, Atlanta, GA, May 21–26, 1995.

M. Mousselmal, D. Faubert, J.J. Evans & M.J. Bertrand, "Comparison of EI and MAB ionization for exact mass measurement", 44th ASMS Conference on Mass Spectrometry and Allied Topics, Portland, OR, May 12–16, 1996.

P. Mireault, D. Faubert, A. Carrier et al., "Evaluation of MAB as a selective Ion Source for Chromatography/Mass Spectrometry Techniques", 44th ASMS Conference on Mass Spectrometry and Allied Topics, Portland, OR, May 12–16, 1996.

D. Faubert, M. Mousselmal, S.G. Roussis & M.J. Bertrand, "Comparison of MAB and EI for petroleum mass spectrometry", 44$^{th}$ ASMS Conference on Mass Spectrometry and Allied Topics, Portland, OR, May 12–16, 1996.
M. Cyr, D. Faubert, M. Mousselmal et al., "Analysis of the emanations from heated polyurethane foam using MAB–MS", 44$^{th}$ ASMS Conference on Mass Spectrometry and Allied Topics, Portland, OR, May 12–16, 1996.
R. J. Slobodrian, J. Giroux, R. Labrie et al., "Highly polarised He($2^3$S) thermal metastable atom source", J. Phys. E: Sci. Instrum., vol. 16, 1983, Great Britain.
D. Faubert, G.J.C. Paul, J. Giroux & M.J. Bertrand, "Selective fragmentation and ionization of organic compounds using an energy–tunable rare–gas metastable beam source", Int'l Journal of Mass Spectrometry and Ion Processes, 124 (1993) 69–77 Elsevier Science Publishers B.V., Amsterdam.
Michel J. Bertrand, D. Faubert, M. Mousselmal & O. Peraldi, "MAB: Metastable Atom Bombardment. A new Ionisation Technique for Analytical Mass Spectrometry and Tandem Mass Spectrometry of Organic Compounds", Centre D'Etudes Du Bouchet and Universite Pierre Et Marie Curie, Essone, France, Mar. 11–13, 1998.
N. Leymarie, M. Bertrand, J.C. Mathurin, A. Bruno, & J.C. Tabet "To adapt a Metastable Atom Beam Source to a Saturn III Ion Trap", 46$^{th}$ ASMS Conference on Mass Spectrometry and Allied Topics, Orlando, FL, May 23–Jun. 4, 1998.
A. Vuica, D. Faubert, M. Evans & M.J. Bertrand, "Analysis of long straight hydrocarbons chains by GC–MAB–MS", 46$^{th}$ ASMS Conference on Mass Spectrometry and Allied Topics, Orlando, FL, May 23–Jun. 4, 1998.
Denis Faubert, H. Pakdel, M. Mousselmal & M.J. Bertrand, "Thermal analysis of a pyrolytic oil in direct combination with the metastable atom bombardment (MAB) source", 46$^{th}$ ASMS Conference on Mass Spectrometry and Allied Topics, Orlando, FL, May 23–Jun. 4, 1998.
Simon Letarte, Moussa Mousselmal, Denis Faubert & Michel J. Bertrand, "Use of MAB–MS for the Characterization of Bacteria", 46$^{th}$ ASMS Conference on Mass Spectrometry and Allied Topics, Orlando, FL, May 23–Jun. 4, 1998.
Jon G. Wilkes, Thomas M. Heinze, James P. Freeman et al., "Use of Probe Sample Introduction with EI or MAB Ionization for Rapid Bacterial Chemotaxonomy", 46$^{th}$ ASMS Conference on Mass Spectrometry and Allied Topics, Orlando, FL, May 23–Jun. 4, 1998.
Jon G. Wilkes, Manuel Holcomb, Fatemeh Rafii et al., "Probe Introduction/MAB/MS for Rapid Bacterial Chemotaxonomy", 46$^{th}$ ASMS Conference on Mass Spectrometry and Allied Topics, Orlando, FL, May 23–Jun. 4, 1998.

N. Leymarie, M. Bertrand, & M. Mousselmal, "Negative Ion Formation in a Metastable Atom Bombardment (MAB) Ion Source", 45$^{th}$ ASMS Conference on Mass Spectrometry and Allied Topics, Palm Springs, CA, Jun. 1–5, 1997.

Denis Faubert, Moussa Mousselmal, Andreea Vuica & M.J. Bertrand, "Use of Nitrogen as a Gas for Metastable Atom Bombardment (MAB™)", 45$^{th}$ ASMS Conference on Mass Spectrometry and Allied Topics, Palm Springs, CA, Jun. 1–5, 1997.

Jonathan M. Curtis & Denis Faubert, "Metastable Atom Bombardment (MAB)/Hybrid Sector–TOF for quantitative GC/MS Analyses", 45$^{th}$ ASMS Conference on Mass Spectrometry and Allied Topics, Palm Springs, CA, Jun. 1–5, 1997.

*Primary Examiner*—Don Wong
*Assistant Examiner*—Ephrem Alemu
*Attorney, Agent, or Firm*—Birch, Stewart, Kolasch & Birch, LLP

[57] ABSTRACT

The metastable atom bombardment source provides a charged particle free beam of metastable species that can be used to bombard and ionize organic and inorganic substances in a gas phase. The metastable atoms are produced by inducing a discharge in a gas (rare gases or small molecules). The discharge is curved between the cathode and anode, with the cathode located in a medium pressure zone and the anode located off-axis in a low pressure zone; A nozzle located between the cathode and the anode provides a collimated beam of metastable atoms of low kinetic energy that is directed at an ion volume containing the substances to be analyzed.

15 Claims, 6 Drawing Sheets

$$A^* + BC \rightarrow A + BC^+ + e^-$$

$$A^* + BC \rightarrow A + B^+ + C + e^-$$

$$A^* + BC \rightarrow ABC^+ + e^-$$

METASTABLE ATOM BOMBARDMENT SOURCE

FIELD OF THE INVENTION

The present invention is directed to an apparatus and method for producing a beam of metastable atoms or molecules, and in particular, a system and method for producing a beam of metastable species for use in ionizing sample substances undergoing analysis by mass spectroscopy or other devices requiring ionization or excitation of substances.

BACKGROUND OF THE INVENTION

Mass spectrometers are well known systems used for the detection and identification of chemical structures and quantitative elemental analysis of substances, In all known mass spectrometry methods, atoms or molecules to be sampled are excited and ionized, so as to create an ion beam, The ion beam is then accelerated through electric and magnetic fields to an ion collector, with the ion collector typically attached to an electrometer. The electrometer then translates signals received from the ion collector into a mass spectrum, which serves to indicate what elements (or radicals or fragments) are contained within the sample.

Many techniques have been suggested to excite and ionize the sample molecules and to fragment the ions from these molecules. These include the use of electrons to bombard species present in the gas phase, such as electron ionization; proton transfer reactions, such as those used in chemical ionization; or photoionization with lasers or other intense light sources. More recently, ionization has been accomplished by the use of metastable atom bombardment, in a which a neutral metastable species is used to bombard the sample molecules and fragment ions from these molecules. The use of metastable atom bombardment in ionizing the sample molecules has allowed the possibility of performing selective ionization, and control over the fragmentation of particles from the sample molecules. However, in order to perform metastable atom bombardment which consistently ionizes the sample material, a reaction mechanism is needed to produce a consistent source of metastable atoms, which is high in its intensity, charge free and low velocity.

A reaction system which produces a beam of metastable atoms is known in the art, and includes a reaction vessel having a source of rare gas at one end of the vessel, a cathode positioned inside the vessel and a small sonic nozzle placed at the other end of the vessel. Outside the vessel is a generally cone shaped anode referred to as a "skimmer" and which further includes an aperture at the apex of the cone. Behind the skimmer is a set of plates which serve as a deflector. In operation, the gas is detected at one end of the vessel and passes through the nozzle at the opposite end. The cathode within the vessel and the anode outside of the vessel are charged by a DC supply, such that a plasma arc is created between the cathode and anode. The atoms of gas which are injected through the discharge are energized to a metastable state, with some of the gas atoms being energized to the point of ionization, thus releasing free ions and electrons into the metastable gas stream. The metastable gas, the free ions and electrons then pass through the aperture in the apex of the skimmer into a set of charged deflector plates, where the free ions/electrons are attracted to the deflector plates, leaving the relatively charge free, metastable gas particles to pass through the deflector plates where it is used to bombard the sample substance to be analyzed by the mass spectroscopy apparatus.

A known disadvantage of this prior art device is that it does not always produce a consistent stream of metastable particles, and sometimes creates a stream of metastable particles mixed with ions/electrons. This occurs because the electric field which surrounds the cathode and anode is symmetric with respect to a longitudinal axis passing through the cathode and anode. As a result of this symmetric electrical field, the forces applied to the ions/electrons and ionized atoms created by the discharge is such that these particles are forced towards this longitudinal axis. Since this longitudinal axis also coincides with the axis of flow, the ions/electrons tend to remain in the flow path along with the metastable gas particles. Although the deflector does remove some of these ionized particles, the forces applied by the symmetric electric field work against the forces applied by the deflector, and thus ions tend to remain within the particle flow. Thus, the prior art apparatus does not produce a beam of purely metastable atoms, and produces spurious, unpredictable results when such a beam is used to ionize the sample to be tested by spectroscopy. The use of a skimmer and deflector plates also results in a larger assembly that causes a loss of metastable atoms. Because of the advantages of using metastable atom bombardment for selective ionization of the sample material, a need exists to improve the metastable atom bombardment system so that the beam of metastable atoms projected against the sample material only contains metastable atoms with a high density.

SUMMARY OF THE INVENTION

It is a feature of the present invention to provide an apparatus which efficiently produces a beam of metastable species having a good purity.

It is another feature of the present invention to provide a method of generating a beam of purely metastable species for use in spectroscopy applications.

According to a broad aspect of the present invention, there is provided an apparatus for generating a beam of metastable species for use in Penning ionization, comprising:

a first chamber having a gas inlet and a nozzle outlet, said inlet being connected to a substantially low pressure source of gas suitable for being energized to a metastable state a inducing Penning ionization and Penning energy transfer;

a cathode arranged in said first chamber;

a second chamber communicating with said nozzle and having a beam outlet substantially in line with said cathode and said nozzle, said second chamber being in communication with a substantially rough vacuum;

an anode arranged in said second chamber to one side of a line extending substantially between said cathode, said nozzle and said beam outlet, wherein an electrical discharge formed between said cathode and said anode passes through said nozzle and then deviates from said nozzle to said anode, and an electric field between said cathode and said anode is asymmetric, whereby a jet of said gas emitted from said nozzle containing metastable and ionized species is projected to said beam outlet while ionized species are diverted from said beam outlet and a beam of said gas emitted from said beam outlet has an improved concentration of metastable species.

BRIEF DESCRIPTION OF THE DRAWINGS

The invention will be better understood by way of the following detailed description of a preferred embodiment with reference to the appended drawings, in which.

DETAILED DESCRIPTION OF THE PREFERRED EMBODIMENT

Figure 1:
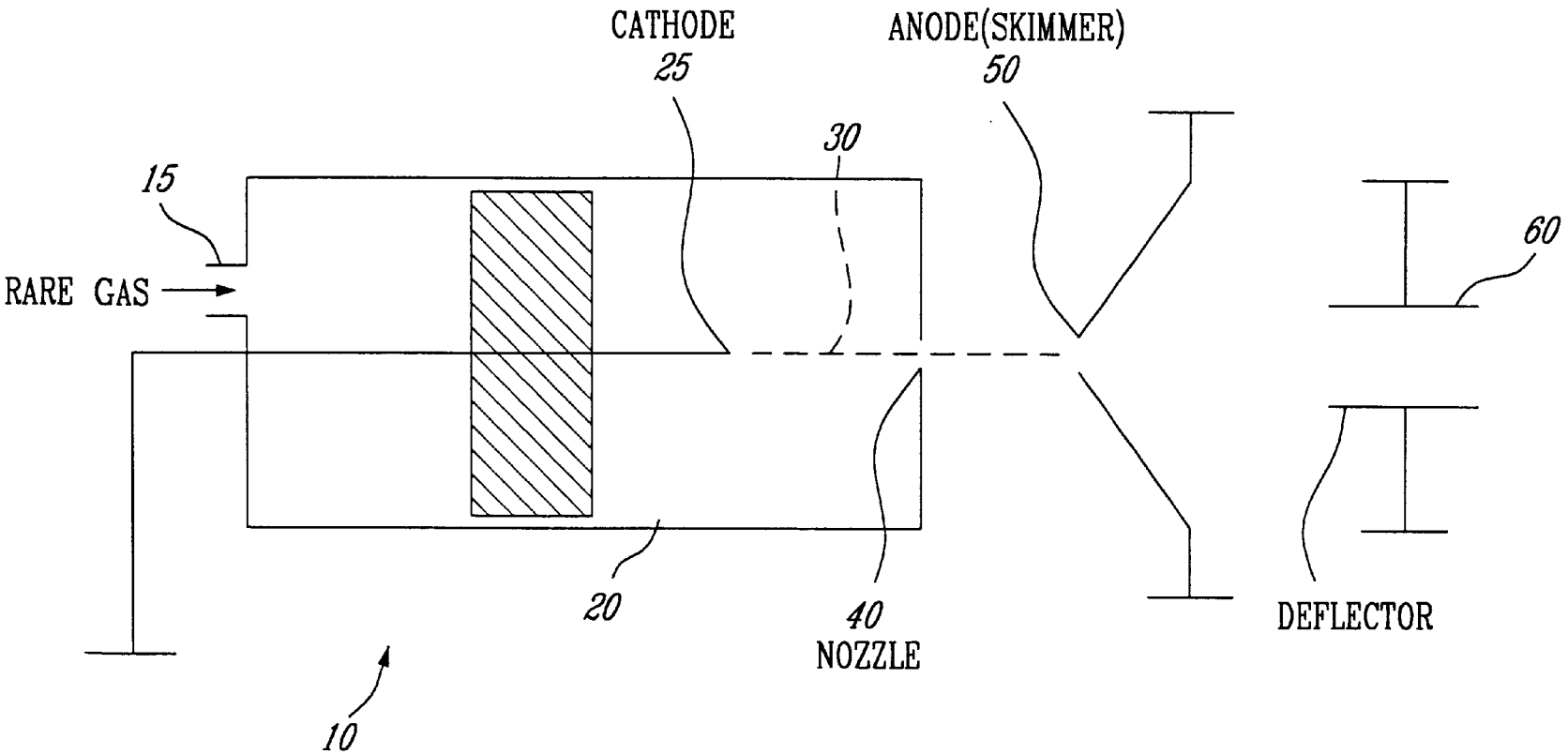
FIG. 1 (PRIOR ART)
FIG. 1 discloses a prior art system for generating a beam of metastable atoms from a source of rare gas.

FIG. 1 discloses a prior art system 10 for generating a beam of metastable atoms from a source of rare gas 15. The source of rare gas 15 is projected into a camber 20 having a pressure gradient from its entry to the beam exit at 50 (anode). Within the chamber 20 is placed an energized cathode 25, while an energized anode 50 is set just outside the chamber 20. Due to the energy applied to t he energized cathode and anode, an electric discharge is generated from the cathode to the anode, extending through the aperture or nozzle 40 in the chamber 20. The rare gas projected into the chamber 20 is driven by the pressure gradient into the discharge between the cathode and anode. The discharge in turn energy the atoms of the rare gas into a mixture of ions/electrons and metastable atoms in which the electrons of these atoms are raised to higher energy levels.

The stream of metastable atoms, ionized atoms and electrons then pass through a charged deflector 60, which removes some of the ions/electrons from the stream of particles. However, because the cathode and anode are in direct axial alignment with one another, a uniform and symmetric electric field is generated around the discharge generated between these two structures. This symmetric electric field in turn generates forces on the charged particles in the stream, namely, the ionized atoms/electrons but not the energized metastable atoms.

The metastable atoms are not charged since they retain their electrons and are not ionized. However, the forces applied on the ions and electrons tends to force these particles towards the longitudinal axis extending between the cathode and anode. As a result, the forces of the symmetric electric field tend to force the charged particles towards the longitudinal axis of the stream, counteracting the effect of the deflector to remove these particles away from the stream and interfering with the passage of the metastable atoms. The net result is that the deflector 60 is not completely effective in removing the charged particles from the particle stream, and the particle stream applied against the sample material is not a stream of purely metastable atoms. Furthermore, the production rate of metastable atoms is relatively poor.

Figure 2:
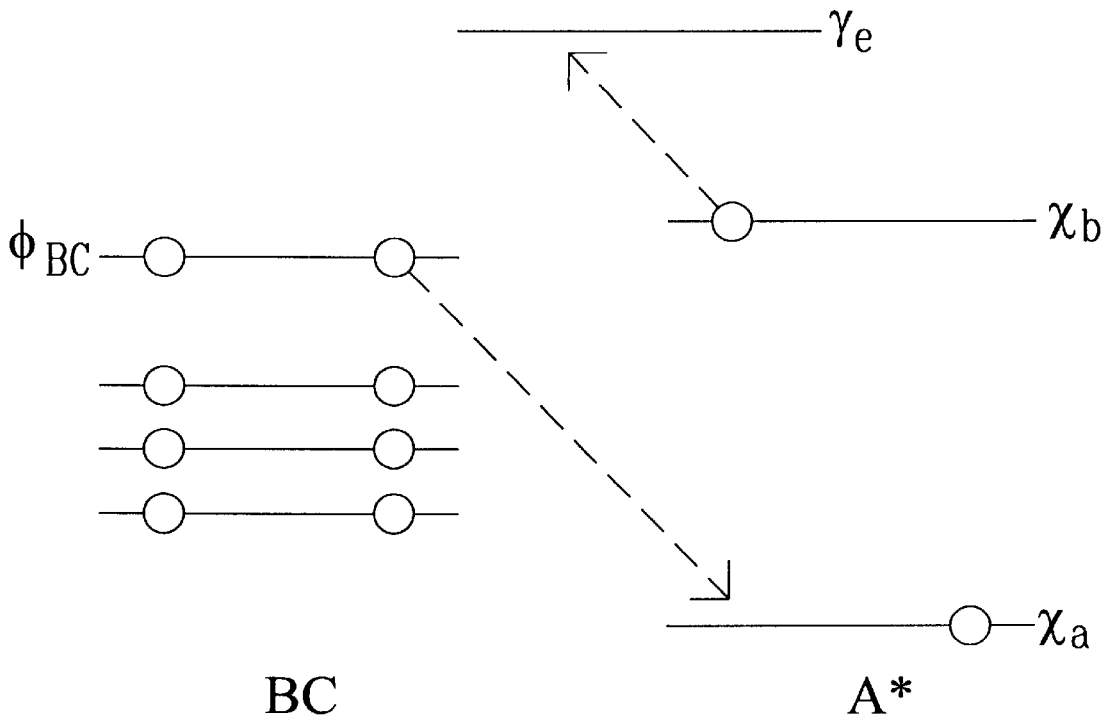
FIG. 2 (PRIOR ART)
FIG. 2 is a diagram illustrating the known mechanism of ionization using a metastable atom source.

When metastable atoms interact with neutral molecules, a process referred to as Penning ionization results. As illustrated in the diagram of FIG. 2, a metastable species A* collides with a neutral molecule BC in the gas phase. An electron from the molecular orbitals of BC attacks the vacant orbital of the metastable species A* and an electron is ejected into the continuum (gamma) leading to ionization as illustrated. The ejected electron can take a range of kinetic energies that is defined by the species involved in the gas phase collision. As illustrated, the result may simply ionize BC, fragment BC into $B^+$ and C (or B and $C^+$), or create $ABC^+$.

The excitation energies of various noble gases change with atomic weight. For example, the $^3S_1$ and $^1S_0$: similarly $^3P_2{}^3P_0$ and states of He are 19.82eV and 20.61eV respectively, the 3P2 and 3P0 states of Ar are 11.55eV and 11.72eV, and the 3P2 and 3P0 states of Xe are 8.32eV and 9.45eV. For nitrogen gas, some more common metastable states are in the range of 8.52eV to 11.88eV. In this specification, reference is often made to rare or noble gases and atoms as being the gases yielding metastable species. It is to be understood that other gases, preferably small molecules such as nitrogen, may also be suitable. It is important to choose a gas that is substantially inert when subjected to the discharge and then mixed with the substance to be ionized, and which provides a suitable excitation energy for ionizing and/or fragmenting the substance to be analyzed.

Figure 3:
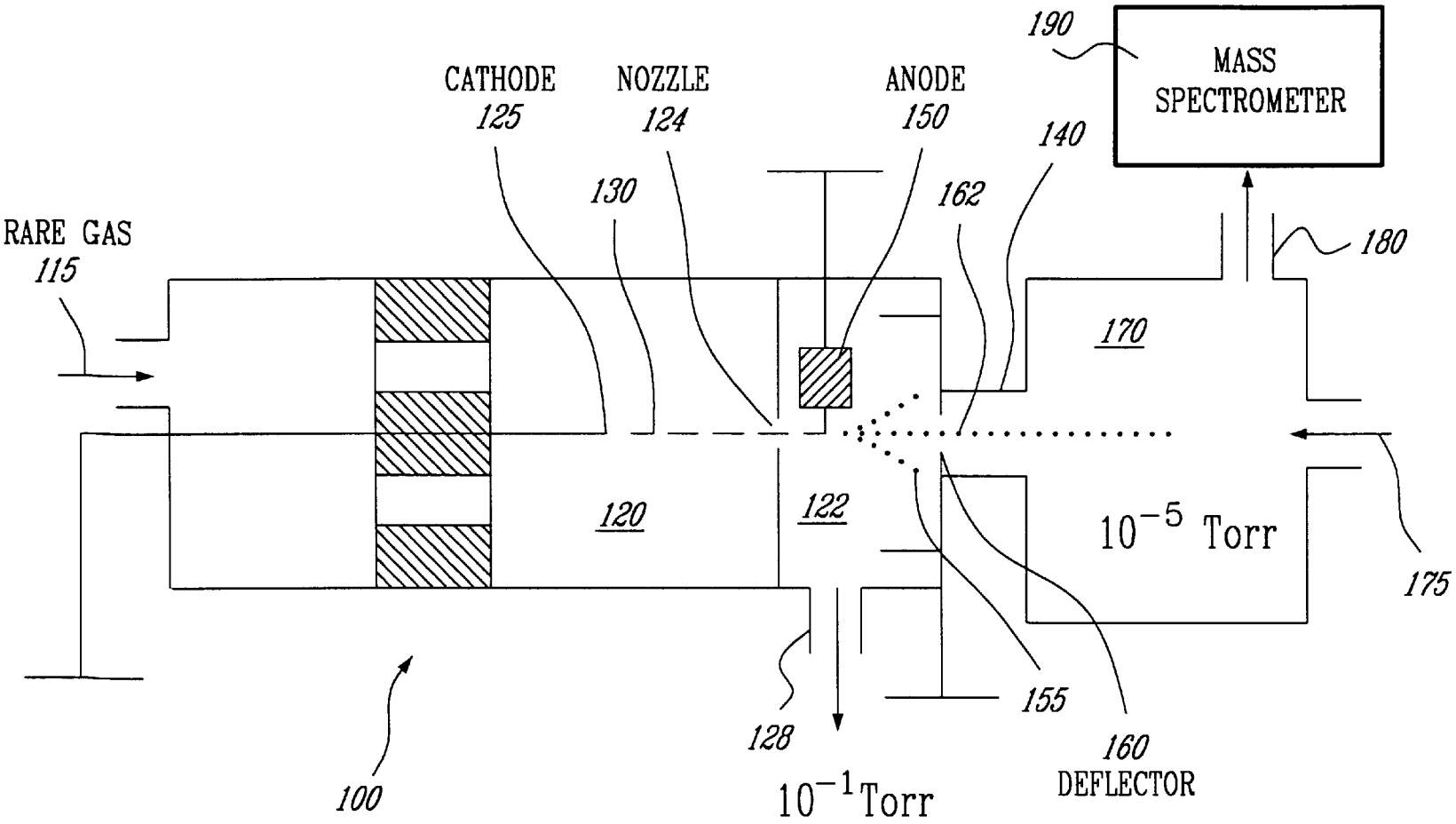
FIG. 3 is a schematic diagram of the apparatus according to the preferred embodiment.

FIG. 3 illustrates a preferred embodiment of the invention, which overcomes the problems created by symmetric electric fields in the particle stream path The preferred embodiment 100 includes a first chamber 120 containing a cathode 125, a first inlet 115 through which the rare gas (or other suitable gas) is supplied at a predetermined pressure and a nozzle orifice 124. A second chamber 122 has an anode 150 positioned off-axis. The first chamber 120 is maintained at a higher pressure than the second chamber 122 such that a jet of gas is created. First and second outlets 128 and 140 respectively in the second chamber 122 are provided, and the pressure in chamber 122 is maintained at about 0.1 Torr. The second outlet 140 is in turn connected to the reaction chamber 170. The reaction chamber 170 includes an inlet 175 for the injection of the sample to be tested, and an outlet 180 communicating with a mass spectrometer 190 which is kept near vacuum pressure.

The first chamber 120 has an inlet 115 for a noble gas and an outlet 124. Chamber 122 is maintained at a reduced pressure of preferably about 0.1 Torr. and has at the right end of the chamber outlet 128, which is less than the pressure of the chamber 120 where the noble gas is injected. This creates a pressure gradient across nozzle 124, so that a gas jet is created in the direction of outlet 140. Inserted into the chambers 120 and 122 are cathode 125 and anode 150 respectively. The cathode 125 and anode 150 are energized so as to create a discharge 130 between the cathode and anode. The discharge 130 has a linear part in chamber 120 and a curved part in chamber 122. The gas receives energy from the discharge 130 mostly in its linear part. As the gas atoms are ejected through nozzle 124, charged particles feel the effect of anode 150 and are deflected.

Unlike the prior art device, the electric field generated by the anode 150 and cathode 125 is asymmetric. This is due to the fact that the cathode 125 and anode 150 are placed along axes that are radially separated from one another. The radial separation creates an asymmetric electric field which tends to force the ions away from the path of the neutral metastable atoms. Thus, when the stream of gas approaches the separation plates 160 and orifice 162, the charged particles are already well separated from the stream of metastable atoms, and the separation plates are more effective at removing these charged particles from the gas stream. It would be possible to reverse the direction of current flow from between the electrodes, however, it is preferred for the cathode to be inside the first chamber, and for the anode to be a flat electrode.

The resultant gas which passes into the chamber 170 is thus substantially a beam of purely metastable atoms. This beam is then bombarded against the sample molecules injected into the reaction chamber 170 at inlet 175. Depending on the energy of the metastable atoms, they are able to ionize the sample up to a certain ionization energy by interaction, as described hereinabove, The ionized sample is then passed on to the mass spectrometer 190 through outlet 180, where it is analyzed accordingly.

The system of the preferred embodiment herein produces a stream or beam of metastable atoms which is collimated, low kinetic energy, charged particle free and high concentration (i.e.>10 ^15 atoms/sec/str). Such a beam is very efficient for performing the metastable atom ionization for mass spectrometry.

Figure 4:
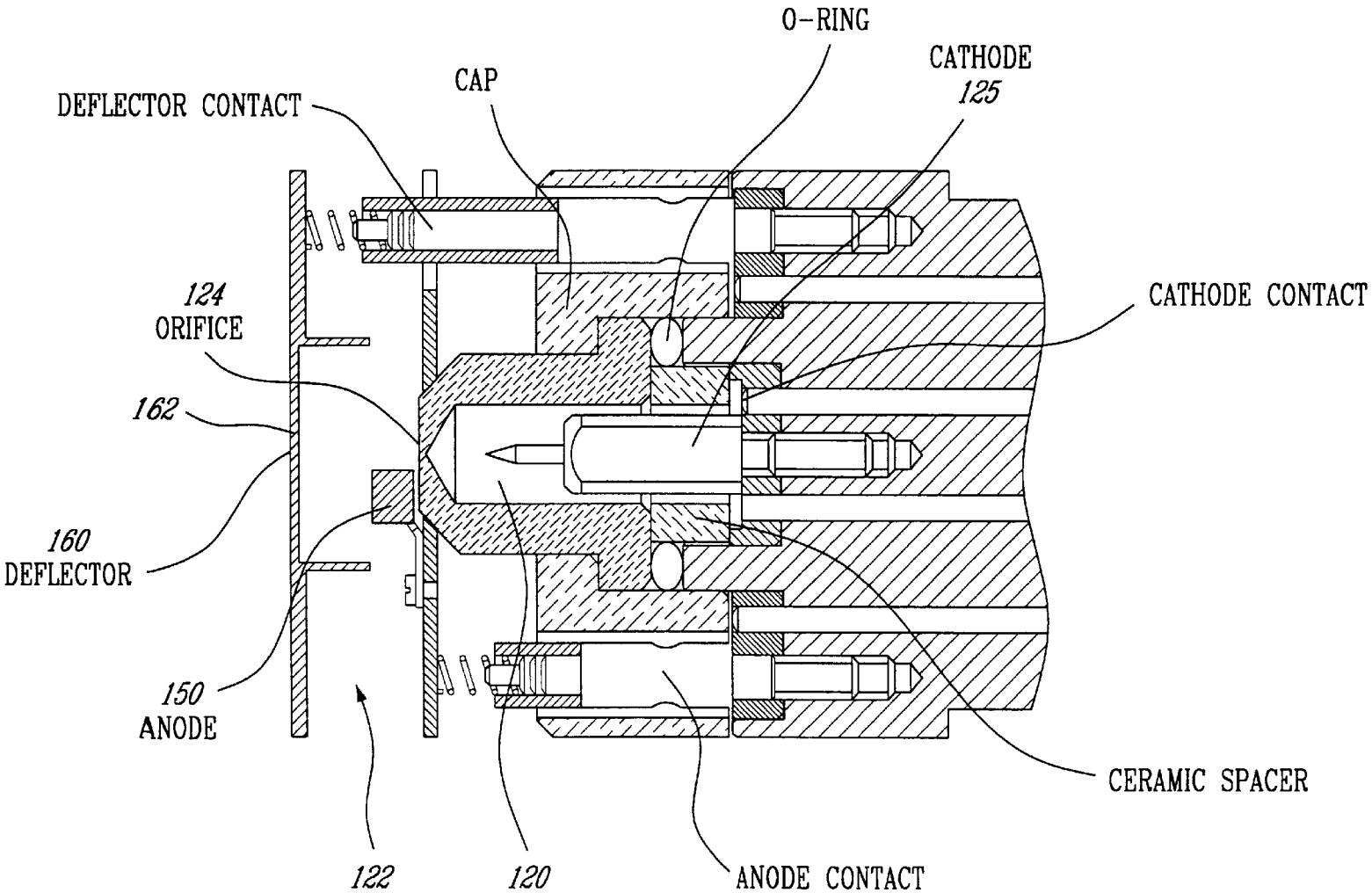
FIG. 4 is a cross-sectional view of the apparatus according to the preferred embodiment.

The construction of the apparat us according to the preferred embodiment is better shown in detail in FIG. 4. The cathode 125 includes a narrow diameter cylindrical tip with a tapered point, while the anode 150 is planar and located off-axis immediately after the nozzle. A curved discharge is created in which the electrons are removed from the center of the gas-flow that contains the metastable species that are not affected by the electrical field. The use of a planar electrode for the anode increases the stability of the discharge (greater surface to collect electrons) and reduces the electrical field in that region of the apparatus. The use of a planar electrode also allows the design to be very compact, thus, reducing the voltage necessary to maintain the discharge The greater collection area for electrons and the reduced voltage combine to locally reduce the heat transfer of the anode thus avoiding overheating and anode erosion. This leads to greater stability of operation.

A distance between the cathode and the nozzle is shown to be about three times the distance between the nozzle and the anode. This distance ratio may be between 1.5 to 4.0 (or more), and provides for a good portion of the energy to be expended inside the first chamber.

Different shapes and materials have been studied for the cathode and the best results were obtained with a simple sharp needle made of pure Copper (without $O_2$), The cathode is a sharp needle (or an assembly of sharp needles) mounted on a cylindrical body. This body can be machined with flats as shown in FIG. 4, or it can be drilled with tiny holes, knurled, (diagonal, straight, diamond pattern), or can be threaded (single or multiple helix). These configurations insure the flow of the rare gas through the body and recenter the cathode in the axis of the orifice. This configuration has also the advantage of pre-heating the rare gas before entering the plasma, conferring more stability to the discharge. It also allows the cathode to be cooled, thus increasing stability. Finally, the cathode is equipped with an internal thread or an external thread (as shown in FIG. 4) to insure proper positioning in the gun-assembly, easy disassembly and good electrical contact with the electrical supply.

The nozzle 124 which is located between the cathode and the anode is used to create a pressure drop in the gun-assembly which leads to the formation of a gas jet The pressure in the first chamber 120 is of the order of 10–100 torr while the pressure in the bottom end second chamber 122 which is differentially pumped is less than one torr. The nozzle is machined in Lava™ material (Grade A, unfired) then the part is fired at 1100° C. for 30 minutes to crystallize the material into a ceramic (expansion factor of 2%). The diameter of the nozzle varies between 120 to 180 $\mu$m for optimum operating conditions with gases such as helium, neon, argon, krypton, xenon and nitrogen ($N_2$). A chamber is provided for aligning the gun on a centering plate as shown in FIG. 4. A lip at the base of the orifice 124 is used to seal the nozzle on the body with an O-ring (or any other suitable sealing means) and maintain the seal. The nozzle is maintained in position by the polyimide cap screwed directly onto the body (an internal thread or screws through the cap). The cap can support the anode and the deflector or can be used as feedthrough for the deflector and the anode contacts as shown in FIG. 4 or any combination of these two configurations depending on the instrument. This design insulates the cathode from the seal and the apparatus body. These critical parts, namely the body and seals, are protected from excessive heating using a ceramic spacer which can also be an extension of the ceramic wall of the nozzle. By removing the cap, it is possible to easily change the nozzle, the cathode or the seal.

The anode 150 can be either bolted on the centering plate or it could alternatively be directly mounted to the cap of the nozzle depending on the configuration of the intent and the space available. This allows the anode to be easily replaced. The anode is a simple stainless steel block or plate located off a axis near the exit of the nozzle (it can also be made from another conducting material). This geometry creates an off-axis asymmetrical electrical field that efficiently removes charged species from the metastable beam.

A circular deflector, to which a negative (or positive) potential up to ± 1kV is applied, is placed after the anode. The deflector is a cup-diaphragm which is an amalgam of normal diaphragm and the cylinder, This cup-diaphragm has several advantages as compared to the previous systems and fulfills several functions. Firstly, it is used to remove any charged particles remaining the beam. The small cylinder in the diaphragm shields the anode and this geometry reduces the interpenetration of the electrical fields generated by other electrodes in the vicinity. The diaphragm also acts as a beam collimator and reduces the penetration of the gas jet in the axis, thus concentrating the metastable species in the center of the beam. This arrangement is more compact than using the planar condenser and allows for differential pumping of this region. The deflector can be mounted directly onto to the cap of the nozzle or onto the instrument used to analyze the ions.

The gases (He, Ne, Ar, Kr, Xe or $N_2$) used to generate the beam of metastable species that is used to bombard molecules/atoms or ions contained in a chamber, on which the gun-assembly is mounted (ion volume or collision cell) are injected into the source via Teflon tubing (or any non-polluting material, not shown in the figures). To avoid the creation of an arc between the cathode and the container (or any grounded parts) the inside diameter of the tubing must be small enough (e.g. 1/32") and the length must be long enough (e.g. over 6 feet). To increase flexibility and productivity, the source is connected to a pneumatic gas control unit which allows for selection and rapid changeover from one gas to another. The gas supply unit also allows the pressure in the gun assembly to be regulated in the gas lines to be pumped. Gas selection can be done manually or automatically (computer controlled).

Figure 5:
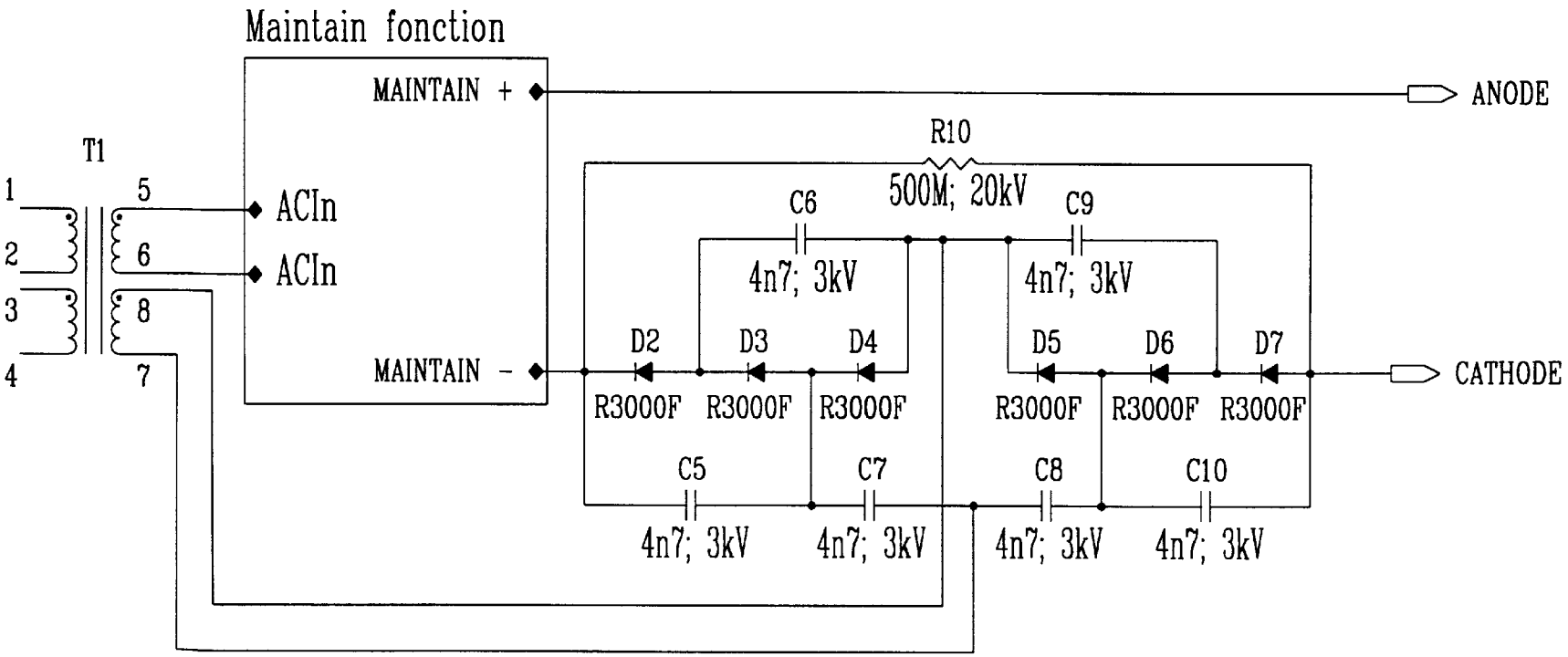
FIG. 5 is a schematic block diagram of the power supply electronic unit according to the preferred embodiment.
Figure 6:
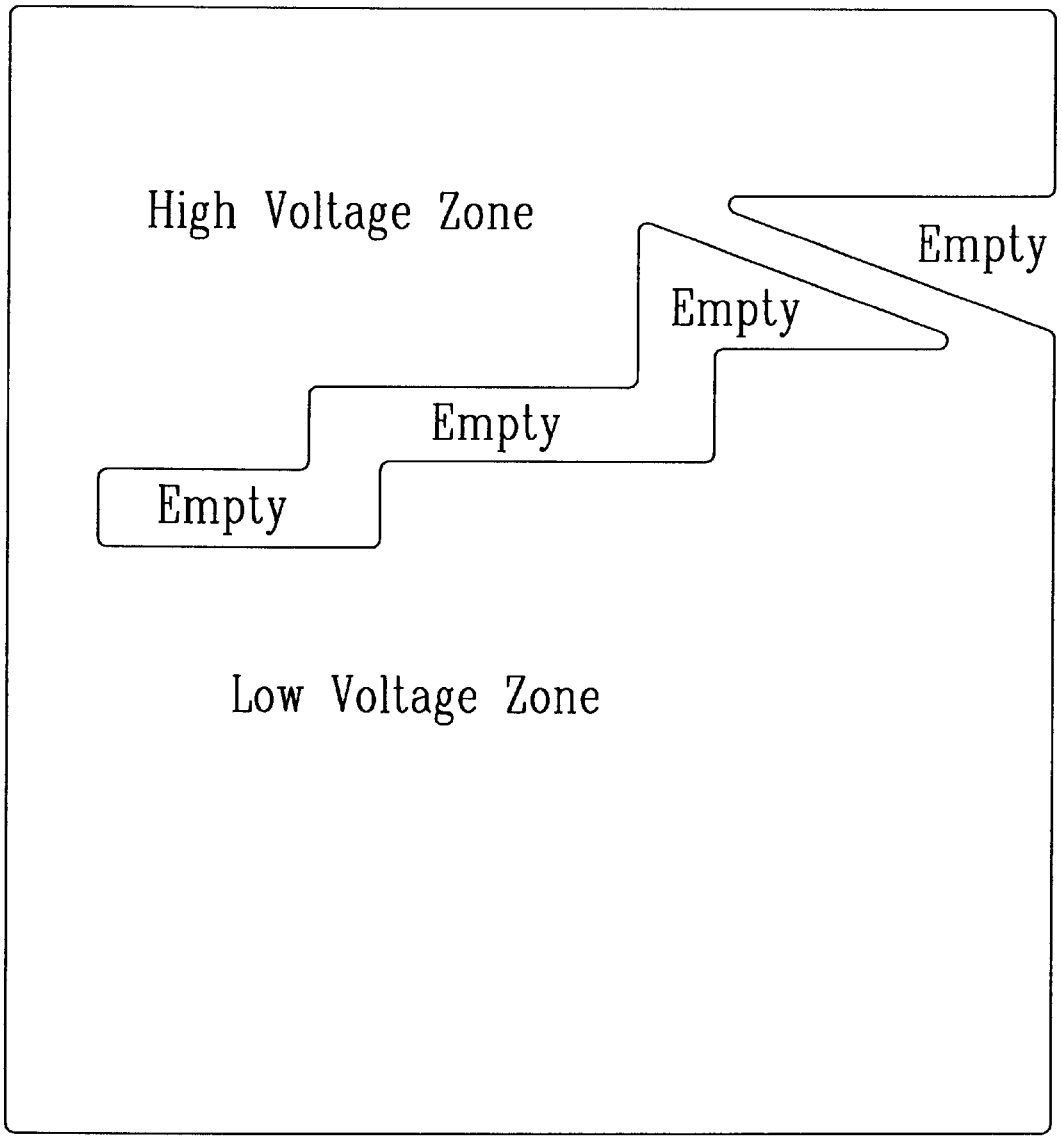
FIG. 6 is a schematic diagram of the circuit board used in the power supply electronic unit according to the preferred embodiment.

In addition to the gas supply it, the gun assembly also has an electronic control unit that initiates and maintains the discharge and optimizes gun parameters. With references to FIGS. 5 and 6, the electronic unit comprises a number of innovative features. The electronic unit uses a voltage boosting device (voltage multiplier) to initiate the discharge. The boosting device is a classical electronic function that multiplies (by integer units) an AC voltage and converts it to a DC voltage. The voltage output of the device is available through its charging period that requires many cycles of a power transformer. Thus, the discharge will always be triggered at the minimum possible voltage after which the booster will turn off. Furthermore, should the discharge turn off at any one time, it will automatically be reinitiated. Hence, this device is secure and eliminates voltage spikes that are not desirable. The boosting device is connected in a series pattern with the means that maintain the plasma or arc. The value of the capacitors of the boosting device is very low (4.7 nF; 3kV), so the magnitude of the plasma current once initiated (around 10 mA DC) discharges very rapidly these capacitors. Since the sustaining current of the plasma is DC, at the moment the plasma is initiated, the charge of the capacitors of the boosting device is blocked by the forward biased diodes (R3000F) of this device. Also, a high voltage bleeder resistor (500MΩ; 20kV) is placed in a parallel configuration with the boosting device in order to assure the security of the users by discharging completely the capacitors of this device in case of non-initiation of the plasma. The electronic supply also controls the discharge current as well as the deflector voltage and their monitoring. The deflector voltage circuitry is protected from overcharge (like short circuits with the cathode) by a high voltage diode (HVR3–12), The "Z" design of the electronic board optimizes space while minimizing electrical interactions and mechanical rigidity. High and low voltage links are made using optic fiber cables and special high voltage resistors configured as voltage dividers with differential reading (use of two voltage dividers). Low voltage components on the board are surrounded by a continuous trace of a grounded conductor located around it on both sides of the board. This protects the electronic elements from a high voltage surface discharge (tracking) from the high voltage zone of the board. The electronic design allows the gun-assembly to be mounted on a low or high voltage instrument (as high as 8kV).

The foregoing description of a specific embodiment of the invention has been presented for purposes of illustration and description. They are not intended to be exhaustive or to limit the invention to the precise forms disclosed and it should be understood that many modifications and variations are possible in light of the above teaching. It is intended that the scope of the invention be defined by the claims appended hereto and their equivalents.

What is claimed is:

1. An apparatus for generating a beam of metastable species for use in Penning ionization, comprising:

a first chamber having a gas inlet and a nozzle outlet, said inlet being connected to a substantially low pressure source of gas suitable for being energized to a metastable state and inducing Penning ionization and Penning energy transfer;

a cathode arranged in said first chamber;

a second chamber communicating with said nozzle and having a beam outlet substantially in line with said cathode and said nozzle, said second chamber being in communication with a rough vacuum;

an anode arranged in said second chamber to one side of a line extending substantially between said cathode, said nozzle and said beam outlet, wherein an electrical discharge formed between said cathode and said anode passes through said nozzle and then deviates from said nozzle to said anode, and an electric field between said cathode and said anode is asymmetric, whereby a jet of gas suitable for being energized to a metastable state emitted from said nozzle containing metastable and ionized species is projected to said beam outlet while ionized species are diverted from said beam outlet and a beam of said gas emitted from said beam outlet has an improved concentration of metastable species.

2. The apparatus as defined in claim 1, further comprising:

charged separation means for separating charged matter from said jet before passing through said beam outlet.

3. The apparatus as defined in claim 2, wherein said charged separation means comprise a single disk having said beam outlet therein, said disk being in a plane perpendicular to a direction of said beam.

4. The apparatus as defined in clam 1, wherein said anode is off-axis and planar, whereby said discharge has greater stability.

5. The apparatus as defined in claim 1, wherein said cathode comprises at least one copper needle.

6. The apparatus as defined in claim 1, wherein said gas is selected from the noble gases and small diatomic gas molecules.

7. The apparatus as defined in claim 6, wherein said nozzle outlet has a diameter between 120 to 180 $\mu$m.

8. The apparatus as defined in claim 1, wherein said nozzle outlet has a dieter between 120 to 180 $\mu$m.

9. The apparatus as defined in claim 1, wherein said source of gas generates a pressure of about 10 to 100 Torr in said first chamber, and said second chamber is at less than about 1 Torr.

10. The apparatus as defined in claim 1, further comprising;

ionization reaction chamber means in communication with said beam outlet and with an inlet of a mass spectrometer.

11. The apparatus as defined in claim 1, wherein said nozzle is made of Lava™.

12. The apparatus as defined in claim 1, further comprising electronic control means connected to said cathode and said anode.

13. The apparatus as defined in claim 12, wherein said electronic control means comprises voltage boosting means.

14. The apparatus as defined in claim 12, wherein said electronic control means comprises a printed circuit board having cut-out means in the form of a Z separating a high voltage side from a low voltage side.

15. An apparatus for generating a beam of metastable atoms for use in Penning ionization, comprising:

a first chamber having a gas inlet and a nozzle outlet, said inlet being connected to a substantially low pressure source of gas suitable for being energized to a metastable state and inducing Penning ionization;

a first electrode arranged in said first chamber;

a second chamber communicating with said nozzle and having a beam outlet substantially in line with said first electrode and said nozzle, said second chamber being in communication with a rough vacuum;

a second electrode arranged in said second chamber to one side of a line extending substantially between said first electrode, said nozzle and said beam outlet, wherein an electrical discharge arc formed between said first and second electrodes passes through said nozzle and then deviates from said nozzle to said second electrode, and an electric field between said first and second electrodes is asymmetric, whereby a jet of gas suitable for being energized to a metastable state emitted from said nozzle containing metastable and ionized species is projected to said beam outlet while ionized species are diverted from said beam outlet and a beam of said gas emitted from